US008135292B2

(12) United States Patent
Chang

(10) Patent No.: US 8,135,292 B2
(45) Date of Patent: Mar. 13, 2012

(54) FIXING DEVICE AND IMAGE FORMING APPARATUS HAVING THE SAME

(75) Inventor: Woong-jae Chang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1043 days.

(21) Appl. No.: 12/020,091

(22) Filed: Jan. 25, 2008

(65) Prior Publication Data

US 2008/0304848 A1 Dec. 11, 2008

(30) Foreign Application Priority Data

Jun. 8, 2007 (KR) ..... 10-2007-0056238

(51) Int. Cl.
*G03G 15/20* (2006.01)

(52) U.S. Cl. ..... 399/33

(58) Field of Classification Search ..... 399/33, 399/67, 69, 70, 320, 328, 329
See application file for complete search history.

(56) References Cited

U.S. PATENT DOCUMENTS 6,647,217 B2 * 11/2003 Tomatsu ..... 399/33
2005/0175367 A1 8/2005 Urabe
2006/0204266 A1 * 9/2006 Watabe ..... 399/69
2007/0098418 A1 * 5/2007 Kang et al. ..... 399/33
2007/0183798 A1 * 8/2007 Moriguchi et al. ..... 399/33
2008/0118266 A1 * 5/2008 Nakayama et al. ..... 399/70

FOREIGN PATENT DOCUMENTS

JP 2005-234469 9/2005

* cited by examiner

*Primary Examiner* — Mark R Gaworecki
(74) *Attorney, Agent, or Firm* — Staas & Halsey LLP

(57) ABSTRACT

A fixing device includes a pressing member, a belt member which rotates in contact with the pressing member and forms a nip with the pressing member, a first roller member and a second roller member to guide a rotation of the belt member, and a heating member which is mounted in one of the first roller member or the second roller member to heat the belt member, the heating member including at least two heaters to respectively heat at least two areas on the belt member corresponding to at least two width dimensions substantially parallel to a rotational axis of the one of the first roller member and the second roller member, and a sensor member to control a temperature of the belt member. The heating member includes a first heater to heat a central portion of the one of the first roller member and the second roller member, and a second heater to heat opposite ends of the one of the first roller member and the second roller member.

15 Claims, 3 Drawing Sheets

FIXING DEVICE AND IMAGE FORMING APPARATUS HAVING THE SAME

CROSS-REFERENCE TO RELATED APPLICATION

This application claims all benefits accruing under 35 U.S.C. §119 from Korean Application No. 2007-56238, filed Jun. 8, 2007, in the Korean Intellectual Property Office, the disclosure of which is incorporated herein by reference.

BACKGROUND OF THE INVENTION

1. Field of the Invention

Aspects of the present invention relate to a fixing device of an image forming apparatus, and more particularly, to a belt-type fixing device and an image forming apparatus having the fixing device.

2. Description of the Related Art

Image forming apparatuses, such as printers, copiers, scanners, multi-function machines, or the like, include fixing devices which apply heat and pressure to and semi-permanently fix developer images. These developer images are transferred onto printing media by transferring units generally known to those skilled in the art. Such fixing devices can be divided into roller-type fixing devices, which include heating rollers containing a heat source and pressing rollers which are biased toward the heating rollers to form nips, and belt-type fixing devices, in which fixing belts are used.

FIG. 1 is a sectional view schematically illustrating an example of a conventional belt-type fixing device 70. As shown in FIG. 1, the conventional belt-type fixing device 70 includes a pressing roller 10, a fixing belt 20 which rotates in contact with the pressing roller 10 and forms a nip N, a first roller 30 and a second roller 40 which guide the rotation of the fixing belt 20, a heat source such as a heating member 50 mounted in the first roller 30 to heat the fixing belt 20, and a sensor member 60 to control the temperature of the fixing belt 20.

The first roller 30 is disposed to face the pressing roller 10 with the fixing belt 20 disposed therebetween. The second roller 40 is spaced apart from the first roller 30 by a predetermined distance. The first and second rollers 30 and 40 support the fixing belt 20 to rotate the fixing belt 20 according to a regular cycle.

The heating member 50 includes a halogen lamp (not shown) contained therein. The heating member 50 is mounted in the second roller 40 along the rotational axis of the second roller 40. The sensor member 60 includes a thermostat, which is mounted in a central latitudinal portion of the fixing belt 20 to detect the surface temperature of the fixing belt 20 heated by the heating member 50.

The conventional belt-type fixing device 70 as described in connection with FIG. 1 applies pressure exerted by the pressing roller 10 and heat applied to the fixing belt 20 to a developer image transferred onto a printing medium P when the recording medium P passes through the nip N formed in a region in which the pressing roller 10 and the fixing belt 20 contact each other. Thus, the conventional belt-type fixing device 70 fixes the developer image onto the printing medium P.

When a printing medium P having a relatively large width dimension, such as an 8.5"×11" sheet of paper, is used in the conventional belt-type fixing device 70 configured as described above, the width of the fixing belt 20 (i.e., the width in a direction substantially parallel to a rotational axis of the fixing belt 20) corresponds to the width of the printing medium P. Thus, the total amount of heat generated from the fixing belt 20 is evenly transferred onto the printing medium P, and there is no latitudinal variation in temperature distribution across the fixing belt 20. However, when a printing medium P having a relatively small width dimension, such as an envelope, is used in the conventional belt-type fixing device 70 configured as described above, the temperature of a portion of the fixing belt 20 through which the printing medium P passes (that is, the central latitudinal portion of the fixing belt 20) is normally reduced, but the temperature of opposite sides, i.e., opposite ends, of the fixing belt 20 which are not in contact with the printing medium P may be only slightly reduced or not reduced at all. Accordingly, if printing media P with low width dimensions, such as envelopes, are continuously fused, the temperature of opposite ends of the fixing belt 20 and/or the pressing roller 10 may increase, because these opposite ends of the fixing belt 20 and/or the pressing roller 10 are not in contact with the printing media P. As a result, the fixing belt 20 or the pressing roller 10 may become overheated and as a result may be damaged or broken.

Additionally, if a printing medium P with a high width dimension, such as an 8.5"×11" sheet of paper, is fused after the printing media P with low width dimensions are continuously fused, a "hot offset" may occur, in which the developer fused at the opposite sides of the overheated fixing belt 20 adheres to the fixing belt 20.

In order to solve the above problems, when a printing medium P with a low width dimension is fused, a method is generally used in which the printing medium P is fused slowly so that the amount of heat generated at the heating member 50 is reduced throughout to reduce variation in temperature distribution. However, many image forming apparatuses have high-speed printing capabilities, so it is inefficient and difficult to use the method for slowly fusing a printing medium P with a low width dimension.

SUMMARY OF THE INVENTION

Aspects of the present invention relate to a fixing device which can constantly maintain a latitudinal temperature distribution across a fixing belt regardless of the size of a printing medium P fixed in a belt-type fixing device, and an image forming apparatus having the fixing device.

Additional aspects and/or advantages of the invention will be set forth in part in the description which follows and, in part, will be obvious from the description, or may be learned by practice of the invention.

According to an aspect of the present invention, a fixing device includes a pressing member; a belt member which rotates in contact with the pressing member and forms a nip with the pressing member; a first roller member and a second roller member to guide the rotation of the belt member; a heating member mounted in one of the first roller member and the second roller member to heat the belt member, the heating member including at least two heaters to respectively heat at least two areas on the belt member corresponding to at least two width dimensions substantially parallel to a rotational axis of the one of the first roller member and the second roller member; and a sensor member to control a temperature of the belt member.

According to an aspect of the present invention, the pressing member includes a rotatable roller, and the belt member may be rotated by a frictional force between the pressing member and the rotatable roller.

According to an aspect of the present invention, the first roller member is disposed to face the pressing member with the belt member disposed therebetween, and the second roller member is spaced apart from the first roller member.

According to an aspect of the present invention, the heating member is mounted in the second roller member.

According to an aspect of the present invention, the heating member includes a first heater to heat a central portion of the one of the first roller member and the second roller member, and a second heater to heat opposite ends of the one of the first roller member and the second roller member.

According to an aspect of the present invention, the first heater and second heater include halogen lamps.

According to an aspect of the present invention, the sensor member includes a first sensor to control an amount of heat generated by the first heater; and a second sensor to control an amount of heat generated by the second heater. The first sensor and second sensor may include thermostats.

According to an aspect of the present invention, the first sensor is disposed within approximately ±25 mm of a maximum heat-generating point of the first heater along the rotational axis of the one of the first roller member and the second roller member, and the second sensor is disposed within approximately ±25 mm of the maximum heat-generating point of the second heater along the rotational axis of the one of the first roller member and the second roller member.

According to another aspect of the present invention, an image forming apparatus includes a photosensitive medium on which an electrostatic latent image is formed, a developing device to develop the electrostatic latent image on the photosensitive medium using developer, a transferring device to transfer a developer image to a printing medium; and a fixing device, as described above, to fix the developer image onto the printing medium.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
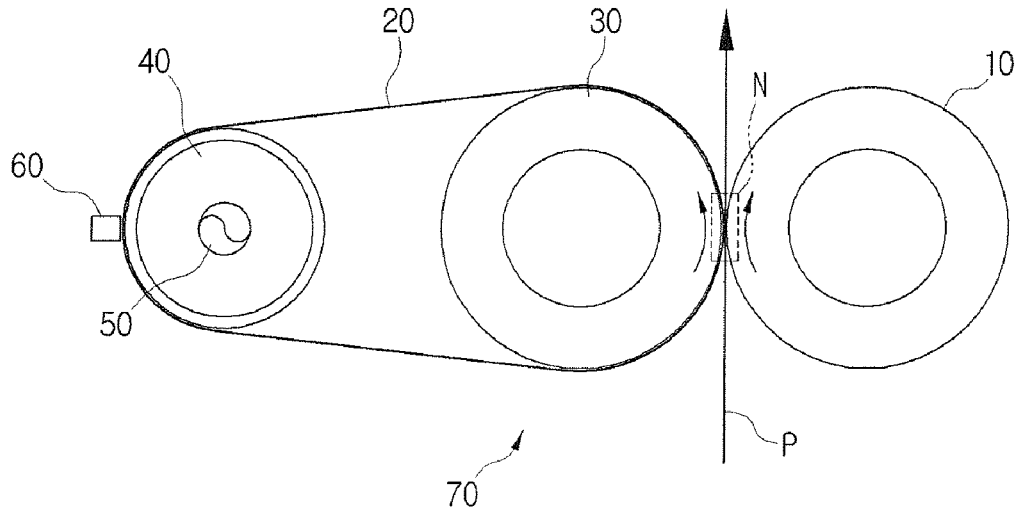
FIG. 1 (PRIOR ART)
FIG. 1 is a sectional view schematically illustrating a conventional belt-type fixing device.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
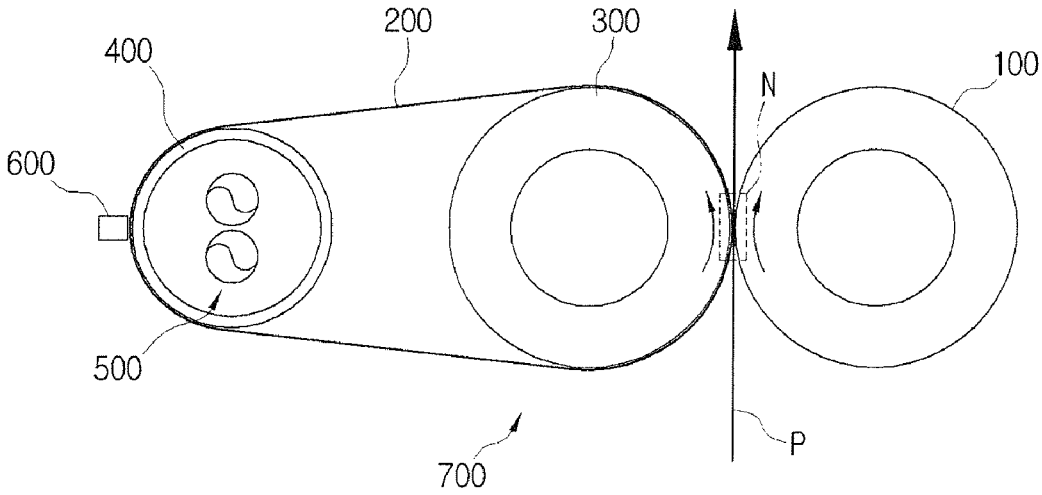
FIG. 2 is a sectional view schematically illustrating a fixing device according to an example embodiment of the present invention.
Figure 3:
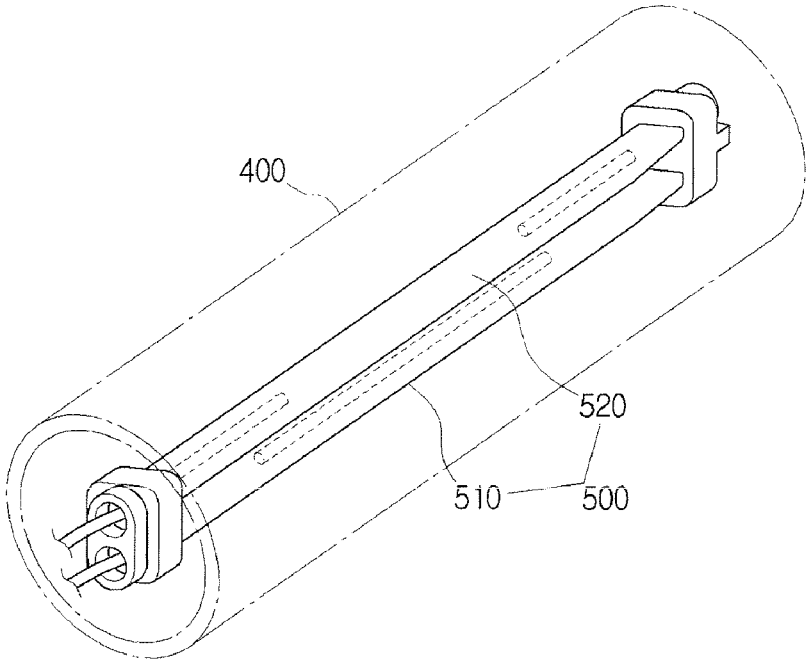
FIG. 3 is a perspective view illustrating an arrangement of a heating unit of a double-heating member shown in FIG. 2.
Figure 4:
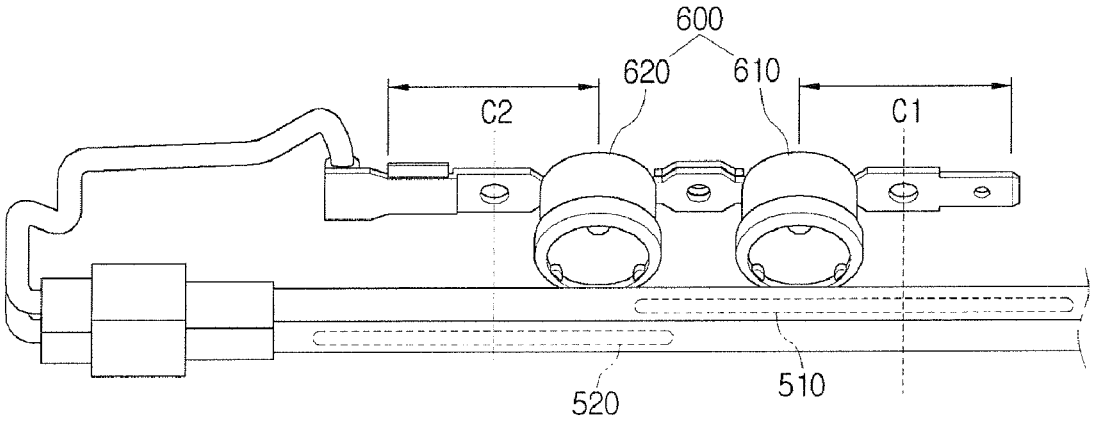
FIG. 4 is a view illustrating the arrangement relationship of a double-heating member and a temperature detecting sensor of a fixing device according to an example embodiment of the present invention.

Referring to FIGS. 2 to 4, a fixing device 700 according to an example embodiment of the present invention includes a pressing member 100, a belt member 200, a first roller member 300 and a second roller member 400, a heating member 500 and a sensor member 600. It is understood that the fixing device 700 may have other components in addition to or instead of those shown in FIGS. 2 to 4 and described below, such as additional rollers, etc.

The pressing member 100 has an elongated cylindrical shape to bias a printing medium P, such as a sheet of paper, an envelope, recycled paper, other types of stationary, etc., towards the belt member 200. The pressing member 100 is rotated by a separate driving source, such as an electric motor. A belt-type pressing member, a pad-type pressing member, and many other types of pressing members known in the art may be used as the pressing member 100 as an alternative to the roller-type pressing member 100 shown in FIG. 2. The rotatable roller-type pressing member 100 according to aspects of the present invention prevents slipping of the fixing belt 20 from occurring when the printing medium P is transferred during the fixing operation.

The roller-type pressing member 100 includes a rotation shaft (not shown) rotatably supported by a frame (not shown) of the fixing device, and an elastic body made of a material such as silicone rubber, non-silicone rubber, plastic, etc. which is disposed on an outer circumference of the rotation shaft. Additionally, the pressing member 100 is biased towards the belt member 200 by an elastic member (not shown), such as, a spring, which is mounted at opposite ends of the rotation shaft.

The belt member 200 rotates in contact with the pressing member 100. A predetermined nip N is formed between the belt member 200 and the pressing member 100. According to an aspect of the present invention, the belt member 200 has a width equal to a length of the pressing member 100 and is made of thermally resistant material. Specifically, the belt member 200 may have a single layer structure comprising metal, a thermally resistant polymer, plastics, etc. Alternatively, the belt member 200 may be configured in a multilayer structure in which an elastic layer, such as silicone, rubber, plastic, etc., is formed on the outer surface of the belt member 200 in order to achieve color printing. It is understood that the belt member 200 is not required to have a width equal to a length of the pressing member 100, and may instead have a longer or shorter width than the pressing member 100.

The belt member 200 has a predetermined tension to rotate smoothly. The pressing member 100 and belt member 200 are configured to generate a predetermined pressurizing force therebetween, which is used to fix a developer image transferred onto the printing medium P. According to an aspect of the present invention a driving mechanism (not shown) is used to rotate the pressing member 100 and the belt member 200 is rotated due to friction with the pressing member 100. However, aspects of the present invention are not limited to this configuration, and separate driving devices may be provided to separately rotate the pressing member 100 and the belt member 200. Additionally, a driving mechanism may instead be connected to the belt member 200, and the pressing member 100 may be rotated due to friction with the rotation of the belt member 200.

The first and second roller members 300 and 400 are used to guide the rotation of the belt member 200. The first roller member 300 is disposed to face the pressing member 100 with the belt member 200 disposed therebetween. The second roller member 400 is spaced apart from the first roller member 300 by a predetermined distance. The first and second roller members 300 and 400 support the belt member 200 so that the belt member 200 rotates at a regular cycle with a predetermined tautness.

According to an aspect of the present invention, the heating member 500 is mounted in the second roller member 400 to heat the belt member 200. According to aspects of the present invention, the heating member 500 includes a first heater 510 and a second heater 520 to heat the belt member 200 to a predetermined fixing temperature. Accordingly, the belt member 200 may be divided into a plurality of latitudinal areas thereof, and different amounts of heat generated by the first and second heaters 510 and 520 may be applied to the plurality of areas of the belt member 200. It is understood, however, that aspects of the present invention are not limited to using two heaters to heat the belt member 200, and may instead use three or more heaters, or may alternatively use one heater with different sections which heat to different temperatures. Additionally, the heating member 500 may instead be mounted in the first roller member 300. Furthermore, more than two roller members may be used.

According to an aspect of the present invention, the first heater 510 is a heater to intensively heat a central latitudinal portion of the pressing member 100, and the second heater 520 is a heater to intensively heat opposite sides of the pressing member 100. According to an aspect of the present invention, halogen lamps are used as the heaters 510 and 520. However, aspects of the present invention are not necessarily limited thereto. For example, heating coils or plane heaters may instead be used as the heaters 510 and 520.

The first and second heaters 510 and 520 are provided in the fixing device 700. When a printing medium P has a relatively large width dimension, such as an 8.5"×11" sheet of paper, the printing medium P may be fused using the same amount of heat generated by the first and second heaters 510 and 520 while the first and second heaters 510 and 520 are controlled to generate heat. Additionally, when a recording medium P has a relatively small width dimension, such as an envelope, the first heater 510 may be controlled to generate a substantial amount of heat and the second heater 520 may controlled to generate a lesser degree of heat, so that opposite sides, i.e., ends, of the belt member 200 which the recording medium P does not contact can be prevented from becoming overheated. Accordingly, aspects of the present invention provide a fixing device 700 capable of almost completely eliminating latitudinal variation in temperature distribution across the belt member 200 regardless of the width dimension of the printing medium P.

The sensor member 600 detects the surface temperature of the belt member 200 to prevent a power source (not shown) from supplying power used to generate heat to the first heater 510 and/or second heater 520 when the belt member 200 is overheated. The sensor member 600 includes a first sensor 610 to control the amount of heat generated by the first heater 510 and a second sensor 620 to control the amount of heat generated by the second heater 520. According to an aspect of the present invention, thermostats may be used as the first sensor 610 and second sensor 620.

According to aspects of the present invention, the first sensor 610 and the second sensor 620 may be appropriately disposed according to light distribution of the first heater 510 and second heater 520. That is, the first sensor 610 and second sensor 620 may be disposed in positions in which it is possible to accurately detect the temperature of the belt member 200 heated by the first heater 510 and second heater 520.

Figure 5:
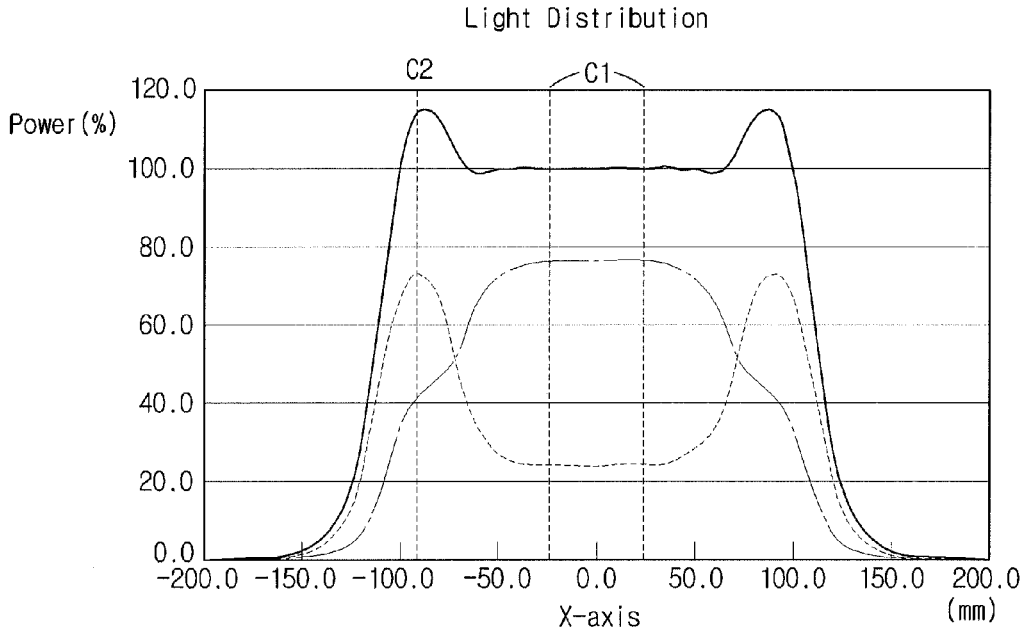
FIG. 5 is a graph illustrating a light distribution of the double-heating member shown in FIG. 4.

FIG. 5 is a graph illustrating light distribution of the first heater 510 and second heater 520. The dashed-dot line, i.e., the line which is shaped like a single bell curve with a maximum value from approximately −50.0 mm to 50 mm along the x-axis, represents the light distribution of the first heater 510. The dashed line, i.e., the line which has two peaks at approximately −80 mm and +80 mm along the x-axis, represents the light distribution of the second heater 520. The solid line represents the total light distribution of the first and second heaters 510 and 520. The x-axis represents a distance from the center (0.0 mm) of the second roller member 400 to the left end (−200.0 mm) and right end (200.0 mm) of the second roller member 400 in a direction along the rotational axis of the second roller member 400.

According to an aspect of the present invention, the first sensor 610 and the second sensor 620 are disposed within approximately ±25 mm of each maximum heat-generating point of the respective first and second heaters 510 and 520. Referring to FIGS. 4 and 5, the second sensor 620 may be disposed approximately ±73.8 mm from the central point of 0.0 mm when the maximum heat-generating point C2 of the second heater 520 is ±90.4 mm from the central point of 0.0 mm, respectively. Additionally, the first sensor 610 may be disposed approximately 48.4 mm from the central point of 0.0 mm when the maximum heat-generating point C1 of the first heater 510 is in the range of −24 mm to +24 mm.

For example, if the first sensor 610 and the second sensor 620 are moved away from the desirable positions described above, such as towards the central point of 0.0 mm by a distance of approximately 27 mm from each maximum heat-generating point of the heaters 510 and 520, the second heater 520 may continue to be heated to an abnormal degree, so an overheat prevention sensor (not shown) connected to the first sensor 610 and the second sensor 620 may not be operated until after the surface temperature of the belt member 200 at the maximum heat-generating point reaches 500° C. or greater. This situation may result in a fire occurring, making the situation very dangerous. However, as described above, when the first sensor 610 and the second sensor 620 are disposed at appropriate positions, for example, within ±25 mm of maximum heat-generating points of the respective first and second heaters 510 and 520, the overheat prevention sensor may be operated before the surface temperature of the belt member exceeds 400° C., so that the power source can be cut off.

Accordingly, when the two heaters 510 and 520 are mounted in the second roller member 400 and when the first sensor 610 and the second sensor 620 are appropriately disposed taking into consideration the light distribution of the two heaters 510 and 520, a more even temperature distribution may be maintained across the belt member 200 regardless of the size of the printing medium P. Additionally, even when one of the heaters 510 or 520 is continuously heated to an abnormal degree, the power source may be cut off before the belt member 200 reaches a temperature at which there is an elevated risk of the belt member 200 being damaged. Thus, aspects of the present invention provide a fixing device 700 with high safety standards.

Figure 6:
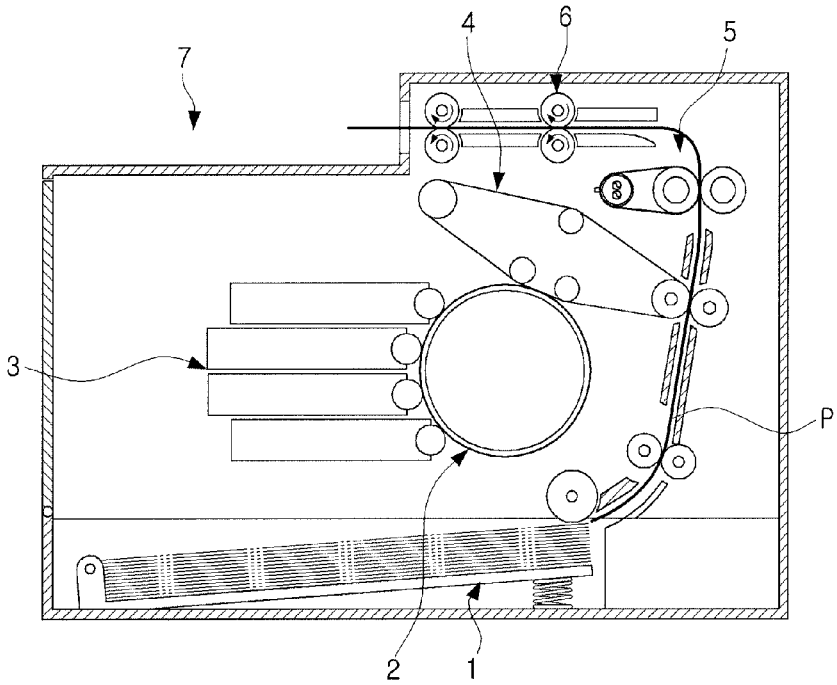
FIG. 6 is a view schematically illustrating an image forming apparatus having a fixing device according to an example embodiment of the present invention.

FIG. 6 is a view schematically illustrating an image forming apparatus 7 in which the fixing device 200 is installed, according to an example embodiment of the present invention. The image forming apparatus 7 of FIG. 6 includes a feeding device 1 in which the printing medium P is loaded, a photosensitive medium 2 on which an electrostatic latent image is formed, a developing device 3 to attach a developer onto the electrostatic latent image on the photosensitive medium 2 and to develop the electrostatic latent image, a transferring device 4 to transfer a developer image developed on the photosensitive medium 2 by the developing device 3 to the printing medium P, the fixing device 5, as described above, to apply heat and pressure to the developer image transferred to the printing medium P and to semi-permanently fix the developer image on the printing medium P and a discharging device 6 to discharge the printing medium P on which the developer image is fixed.

The feeding device 1, the photosensitive medium 2, the developing device 3, the transferring device 4 and the discharging device 6 of the image forming apparatus 7 are known to those skilled in the art, so more detailed descriptions thereof are omitted. Additionally, the fixing device 700 according to aspects of the present invention is not limited to being installed in the image forming apparatus shown in FIG. 7, and may also be installed in a wide variety of image forming apparatuses, such as copiers, facsimiles, multi-function apparatuses, image forming apparatuses with s-shape feeding paths, image forming apparatuses with multiple developing devices 3, etc.

In the fixing device 700 according to aspects of the present invention, the belt member 200 does not partially overheat even when a printing medium of a small width dimension or unusual design is used. Additionally, even when the heating member 500 of the fixing device 700 is heated to an abnormal degree, the temperature of the heating member 500 is detected before the heating member 500 reaches a temperature at which there is an elevated risk of the belt member being damaged or catching on fire, so that the power source may be cut off. Thus, the fixing device 700 according to aspects of the present invention make it possible to safely obtain prints of high quality.

As described above, according to aspects of the present invention, a more even temperature distribution may be maintained across the belt member 200 regardless of the size of the printing medium P. Additionally, even when only one of the heaters 510 or 520 is continuously heated to an abnormal degree, the power source may be cut off before the belt member 200 reaches a temperature at which there is an elevated risk of the belt member 200 being damaged, making it possible to provide a fixing device 700 with high safety standards.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the second roller member 400 may have more than two heaters corresponding to more than two sizes of printing media P. Accordingly, it is intended, therefore, that aspects of the present invention not be limited to the various example embodiments disclosed, but that aspects of the present invention include all embodiments falling within the scope of the appended claims.

What is claimed is:

1. A fixing device comprising:

a pressing member;

a belt member which rotates in contact with the pressing member and forms a nip with the pressing member;

a first roller member and a second roller member to guide the rotation of the belt member;

a heating member mounted in the second roller member to heat the belt member, the heating member comprising at least two heaters to respectively heat at least two areas on the belt member corresponding to at least two width dimensions substantially parallel to a rotational axis of the one of the second roller member; and a sensor member to detect the surface temperature of the belt member so as to prevent a power source from supplying power used to generate heat to the first heater and/or second heater when the belt member is overheated;

wherein the at least two heaters comprise a first heater to heat a central portion of the second roller member and a second heater to heat opposite ends of the second roller member and the first heater and the second heater are disposed in a manner that the end portions of the heaters are adjacent to each other, wherein, the sensor member is disposed at a region where the end portion of the first heater is adjacent to the end portion of the second heater.

2. The fixing device of claim 1, wherein the pressing member comprises a rotatable roller, and the belt member is rotated by a frictional force between the pressing member and the belt member.

3. The fixing device of claim 1, wherein:

the first roller member is disposed to face the pressing member with the belt member disposed therebetween, and the second roller member is spaced apart from the first roller member.

4. The fixing device of claim 1, wherein the first heater and the second heater comprise halogen lamps.

5. The fixing device of claim 1, wherein the sensor member comprises: a first sensor to control an amount of heat generated by the first heater; and a second sensor to control an amount of heat generated by the second heater.

6. The fixing device of claim 5, wherein the first sensor is disposed within approximately ±25 mm of a maximum heat-generating point of the first heater along the rotational axis of the one of the first roller member and the second roller member, and the second sensor is disposed within approximately ±25 mm of a maximum heat-generating point of the second heater along the rotational axis of the one of the first roller member and the second roller member.

7. The fixing device of claim 1, wherein a maximum heat-generating point is created at a region where the end portion of the first heater is adjacent to the end portion of the second heater.

8. An image forming apparatus comprising:

a photosensitive medium on which an electrostatic latent image is formed;

a developing device to develop the electrostatic latent image on the photosensitive medium using developer;

a transferring device to transfer a developer image to a printing medium; and a fixing device to fix the developer image transferred onto the printing medium, wherein the fixing device comprises:

a pressing member, a belt member which rotates in contact with the pressing member and forms a nip with the pressing member, a first roller member and a second roller member to guide the rotation of the belt member, a heating member which is mounted in one of the first roller member and the second roller member to heat the belt member, the heating member comprising at least two heaters to respectively heat at least two areas on the belt member corresponding to at least two width dimensions substantially parallel to a rotational axis of the one of the first roller member and the second roller member, and a sensor member to control a temperature of the belt member, wherein the heating member comprises a first heater to heat a central portion of the one of the first roller member and the second roller member and a second heater to heat opposite ends of the one of the first roller member and the second roller member, wherein the sensor member comprises a first sensor to control an amount of heat generated by the first heater and a second sensor to control an amount of heat generated by the second heater, wherein the first sensor is disposed within approximately ±25 mm of a maximum heat-generating point of the first heater along the rotational axis of the one of the first roller member and the second roller member.

9. The image forming apparatus of claim 8, wherein the pressing member comprises a rotatable roller, and the belt member is rotated by a frictional force between the pressing member and the belt member.

10. The image forming apparatus of claim 8, wherein:

the first roller member is disposed to face the pressing member with the belt member disposed therebetween, and the second roller member is spaced apart from the first roller member.

11. The image forming apparatus of claim 10, wherein the heating member is mounted in the second roller member.

12. The image forming apparatus of claim 8, wherein the first sensor and the second sensor comprise thermostats.

13. The image forming apparatus of claim 8, wherein the second sensor is disposed within approximately ±25 mm of a maximum heat-generating point of the second heater along the rotational axis of the one of the first roller member and the second roller member.

14. A fixing device to fix an image on a printing medium passing through an image forming apparatus, comprising:

a pressing member;

a belt member which rotates in contact with the pressing member and forms a nip with the pressing member;

a first roller member and a second roller member to guide the rotation of the belt member; and a heating member mounted in one of the first roller member and the second roller member, to generate different amounts of heat along a direction which is substantially parallel to a rotational axis of the one of the first roller member and the second roller member, based on a width of the printing medium, a sensor member comprising at least two sensors to control a temperature of the belt member, wherein the heating member comprises a first heater and a second heater to respectively heat at least two areas on the belt member corresponding to at least two width dimensions substantially parallel to the rotational axis of the one of the first roller member and the second roller member, and wherein a first sensor from among the at least two sensors is disposed within approximately ±25 mm of a maximum heat-generating point of the first heater along the rotational axis of the one of the first roller member and the second roller member.

15. The fixing device of claim 14, further comprising a second sensor from among the at least two sensors, disposed within approximately ±25 mm of a maximum heat-generating point of the second heater along the rotational axis of the one of the first roller member and the second roller member.

* * * * *